US010979840B2

(12) United States Patent
Meng et al.

(10) Patent No.: US 10,979,840 B2
(45) Date of Patent: Apr. 13, 2021

(54) METHOD FOR MANUFACTURING MEMS MICROPHONE

(71) Applicant: AAC Acoustic Technologies (Shenzhen) Co., Ltd., Shenzhen (CN)

(72) Inventors: Zhenkui Meng, Shenzhen (CN); Zhengyan Liu, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 16/708,393

(22) Filed: Dec. 9, 2019

(65) Prior Publication Data

US 2020/0213796 A1 Jul. 2, 2020

(30) Foreign Application Priority Data

Dec. 31, 2018 (CN) ..... 201811651259.7

(51) Int. Cl.

| | |
|---|---|
| ***H04R 31/00*** | (2006.01) |
| ***H04R 19/04*** | (2006.01) |
| ***H04R 7/10*** | (2006.01) |

(52) U.S. Cl.

CPC ..... *H04R 31/003* (2013.01); *H04R 7/10* (2013.01); *H04R 19/04* (2013.01); *H04R 2201/003* (2013.01); *H04R 2307/025* (2013.01)

(58) Field of Classification Search

CPC ..... H04R 31/003; H04R 7/10; H04R 19/04; H04R 2201/003; H04R 2307/025; B81B 2201/0257; B81C 1/00134; B81C 1/00158; B81C 1/00182

See application file for complete search history.

(56) References Cited

U.S. PATENT DOCUMENTS

2017/0230757 A1* 8/2017 Kuntzman ..... H04R 3/005

* cited by examiner

*Primary Examiner* — Mark Fischer

(74) *Attorney, Agent, or Firm* — W&G Law Group LLP

(57) ABSTRACT

The invention provides a method for manufacturing a MEMS microphone. The method comprises steps of: preparing a base; forming a first diaphragm on a first surface of the base; preparing a back plate; forming a first gap between the first diaphragm and the back plate; preparing a second diaphragm opposite to the first diaphragm; forming a second gap between the second diaphragm and the back plate; preparing electrodes on the second diaphragm; forming a back cavity by etching a second surface of the base opposite to the first surface.

9 Claims, 8 Drawing Sheets

METHOD FOR MANUFACTURING MEMS MICROPHONE

FIELD OF THE PRESENT DISCLOSURE

The invention relates to the technical field of transducers for converting soundwaves into electrical signals, in particular to a microphone and a method for manufacturing a microphone by MEMS process (Micro-Electro-Mechanic Systems).

DESCRIPTION OF RELATED ART

With the development of wireless communication, the users have increasingly higher requirements for the call quality of mobile phones, and the design of microphone as a speech pickup device has a direct influence on the call quality of mobile phone.

As MEMS technology is featured by miniaturization, good integratability, high performance, low cost and the like, it has been appreciated by the industry, and MEMS microphone is widely used in current mobile phones; the common MEMS microphone is capacitive, i.e., including a vibrating diaphragm and a back plate which both constitutes a MEMS Acoustic sensing capacitance, and the MEMS acoustic sensing capacitance further outputs an acoustic signal to a processing chip for signal processing by connecting to the processing chip through a connecting plate. To further improve the performance of MEMS microphone, a dual-diaphragm MEMS microphone structure has been proposed in the prior art, i.e., two layers of vibrating diaphragm are used to constitute a capacitance structure with the back plate respectively. In the MEMS microphone based on silicon technology, the vibrating diaphragm and back plate of the above MEMS microphone are on the same silicon foundation and made with semiconductor making process, and it also comprises process steps such as forming an acoustic cavity, back cavity, acoustic hole, venting hole and connecting plate during manufacturing.

As each making process step of MEMS microphone is to make and form on the same silicon base, each process step can only be conducted after the previous process step is finished, thus causing a relatively low efficiency of manufacturing MEMS microphone.

Based on the above problems, it's necessary to provide a new method for manufacturing MEMS microphone dual-diaphragm structure to improve manufacturing efficiency.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENTS

The present disclosure will hereinafter be described in detail with reference to several exemplary embodiments. To make the technical problems to be solved, technical solutions and beneficial effects of the present disclosure more apparent, the present disclosure is described in further detail together with the figure and the embodiments. It should be understood the specific embodiments described hereby are only to explain the disclosure, not intended to limit the disclosure.

Figure 1:
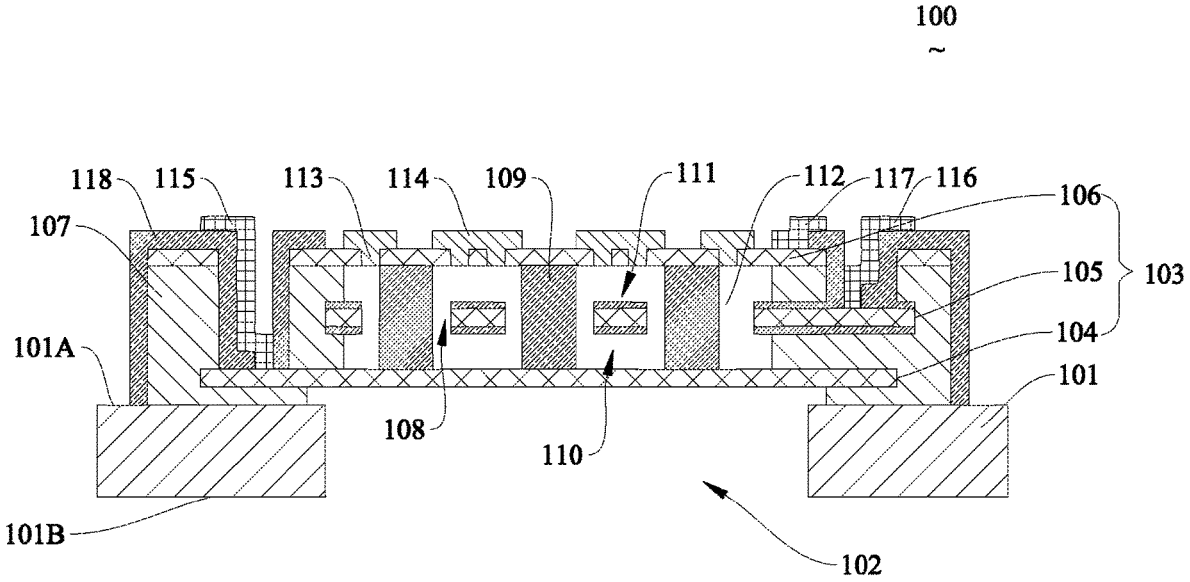
FIG. 1 is an illustration of a MEMS microphone in accordance with a first embodiment of the present invention.
Figure 2:
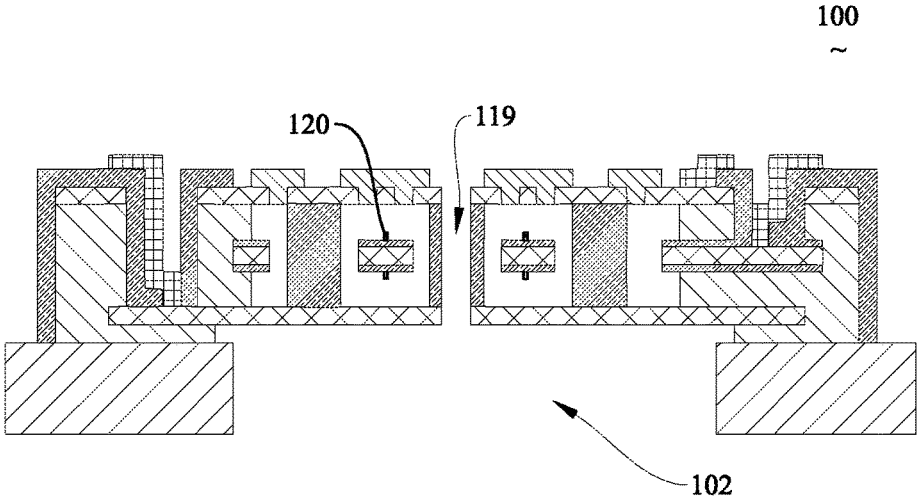
FIG. 2 is an illustration of a MEMS microphone in accordance with a second embodiment of the present invention.

With reference to FIGS. 1-2, a MEMS microphone structure 100 prepared by the manufacturing method of the invention comprises a base 101 and a capacitance system 103 placed on the base 101 and insulatively connected with the base 101.

The material of the base 101 is preferably semiconductor material, such as silicon, which has a back cavity 102, a first surface 101A and a second surface 101B opposite to the first surface, an insulation layer 107 provided on the first surface 101A of the base 101 with a back cavity 102 through the insulation layer 107, and the first and second surfaces of the base 101. Wherein the back cavity 102 can be formed through corrosion by a bulk-silicon process and dry method.

The electric capacitance system 103 includes a back plate 105 and a first diaphragm 104 and a second diaphragm 106 which are opposite to the back plate 105 and are respectively arranged on both sides of the back plate 105. An insulation layer 107 is arranged between the first diaphragm 104 and the back plate 105, between the second diaphragm 106 and the back plate 105, and between the first diaphragm 104 and the base 101. The central main body area of the back plate 105 includes an acoustic through-hole 108 arranged at intervals. In the present invention, the central main body area of the back plate 105 is, for example, the area corresponding to the back cavity 102, and the area outside this area is the edge area of the back plate 105. The supporting component 109 fixedly connects the first diaphragm 104 and the second diaphragm 106 through the acoustic through hole. Specifically, the supporting part 109 is abutted with a top surface of the first vibrating diaphragm 104 and a bottom surface of the second vibrating diaphragm 106 respectively. The insulation layer 107 separates the first diaphragm 104 and the back plate 105 for a certain distance and forms a first gap 110, and separates the second diaphragm 106 and the back plate 105 for a certain distance and forms a second gap 111. The acoustic through hole 108 penetrates the first gap 110 and the second gap 111 to form an inner cavity 112. When the MEMS microphone is powered on to work, the first vibrating diaphragm 104 and the back plate 105, the second vibrating diaphragm 106 and the back plate 105 will carry charges of opposite polarity to form capacitance, when the first vibrating diaphragm 104 and the second vibrating diaphragm 106 vibrate under the action of acoustic wave, the distance between the back plate 105 and the first vibrating diaphragm 104, between it and the second vibrating diaphragm 106 will change, so as to cause changes in capacitance of the capacitance system, which in turn converts the acoustic wave signal into an electrical signal to realize corresponding functions of the microphone.

In this embodiment, the first vibrating diaphragm 104 and the second vibrating diaphragm 106 are square, round or elliptical. At least one supporting part 109 is placed between the bottom surface of the first vibrating diaphragm 104 and the top surface of the second vibrating diaphragm 106.

The supporting part 109 is placed to penetrate through the acoustic through hole 108 of the back plate 105 to fixedly connect the first vibrating diaphragm 104 and the second vibrating diaphragm 106; i.e., the supporting part 109 has no contact with the back plate 105 and no influence from the back plate 105.

The supporting part 109 can be formed on the top surface of the first vibrating diaphragm 104 with all kinds of preparing technology, such as physical vapor deposition, electrochemical deposition, chemical vapor deposition and molecular beam epitaxy.

The supporting part 109 can be constituted by semiconductor material such as silicon or can comprise semiconductor material such as silicon. For example, germanium, SiGe, silicon carbide, gallium nitride, indium, indium gallium nitride, indium gallium arsenide, indium gallium zinc oxide or other element and/or compound semiconductor (e.g., III-V compound semiconductor or II-VI compound semiconductor such as gallium arsenide or indium phosphide, or ternary compound semiconductor or quaternary compound semiconductor). It can also be constituted by or comprise at least one of the followings: metal, dielectric material, piezoelectric material, piezo-resistive material and ferroelectric material. It can also be made from dielectric material such as silicon nitride.

According to the embodiments, the supporting part 109 can be integrally molded with the first vibrating diaphragm 104 and the second vibrating diaphragm 106.

According to various embodiments, the second diaphragm 106 of the present invention includes a number of releasing holes 113. The releasing hole 113 is sealed with a dielectric material 114.

According to the embodiments, it also comprises the extraction electrodes of the first vibrating diaphragm 104, the second vibrating diaphragm 106 and the back plate 105, correspondingly a first electrode 115, a second electrode 116, a third electrode 117.

According to various embodiments, the surface passivation protection layer 118 is also included.

Refer to FIG. 2, it also comprises a through hole 119 through the first vibrating diaphragm 104, the supporting part 109, the second vibrating diaphragm 106, the through hole 119, for example, is placed at the central position of the first vibrating diaphragm 104, the second vibrating diaphragm 106, communicating the back cavity 102 with the external environment, thus resulting in a consistent external pressure of the first vibrating diaphragm 104 and the second vibrating diaphragm 106.

Figure 3:
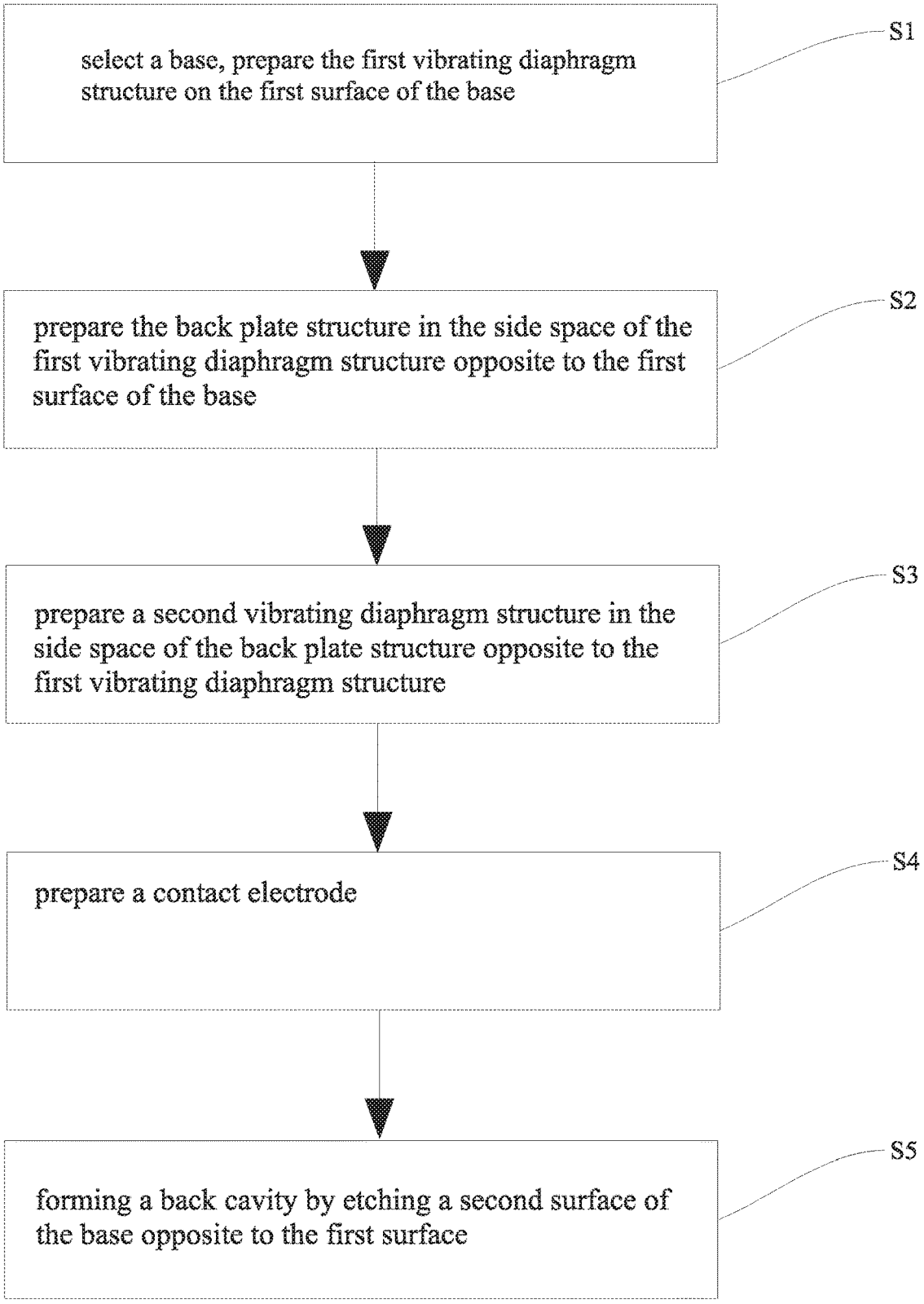
FIG. 3 is a flow chart of a method for manufacturing the MEMS microphone.

Refer to FIGS. 3-4, it's a flow chart of an embodiment of a manufacturing method for a MEMS microphone provided by the invention, the manufacturing method is used to manufacture the microphone 100 as shown in FIG. 1 or FIG. 2, specifically it comprises the following steps.

Figure 4A:
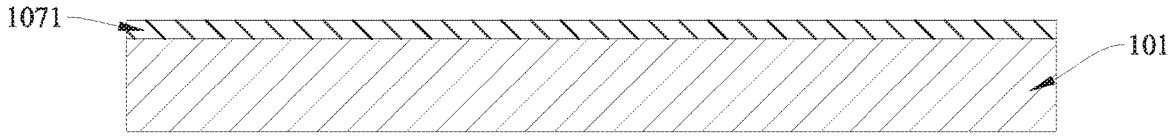
FIGS. 4A-4V indicate the steps of the method for manufacturing the MEMS microphone.

Step S1, select a base, prepare the first vibrating diaphragm structure on the first surface of the base:

Specifically, it comprises the following sub-steps:

S11, a base 101 is selected and a first oxide layer 1071 is deposited on the first surface 101A of the base 101, as shown in FIG. 4A.

The base 101, for example, is a semiconductor silicon substrate, or a substrate of other semiconductor material such as: germanium, SiGe, silicon carbide, gallium nitride, indium, indium gallium nitride, indium gallium arsenide, indium gallium zinc oxide or other element and/or compound semiconductor (e.g., III-V compound conductor such as gallium arsenide or indium phosphide) germanium or and gallium nitride the like.

For example, the first oxide layer 1071 is silicon dioxide with a thickness of about 1 μm, which is formed by conventional processes by adopting thermal oxidation and vapor deposition.

Figure 4B:
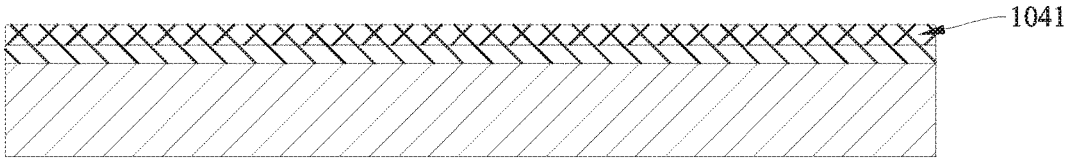
Figure 4C:
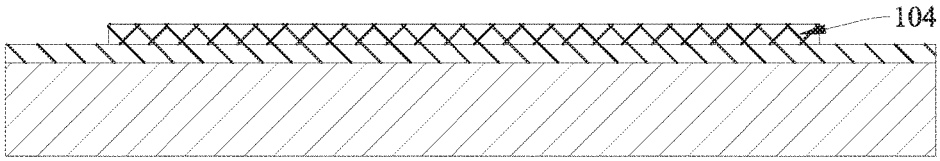

S12, the first polycrystalline silicon layer 1041 is deposited on the first oxide layer 1071, for example, the thickness of the first polycrystalline silicon layer 1041 is about 1 μm, as shown in FIG. 4B;

S13, etch the first polycrystalline silicon layer 1041. According to the structural requirements of the first diaphragm 104, etch the first polycrystalline silicon layer 1041 to form the basic structure of the first diaphragm 104, as shown in FIG. 4C.

Figure 4D:
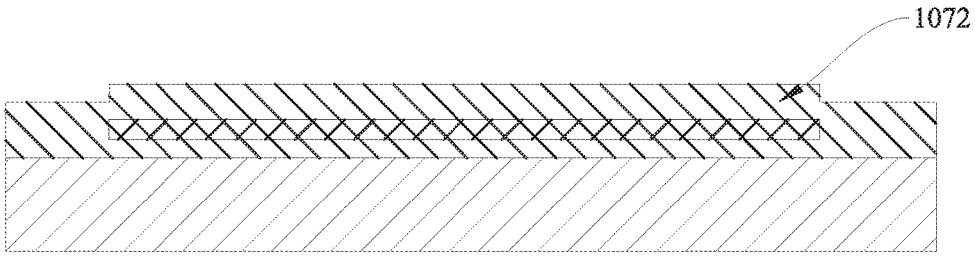
Figure 4E:
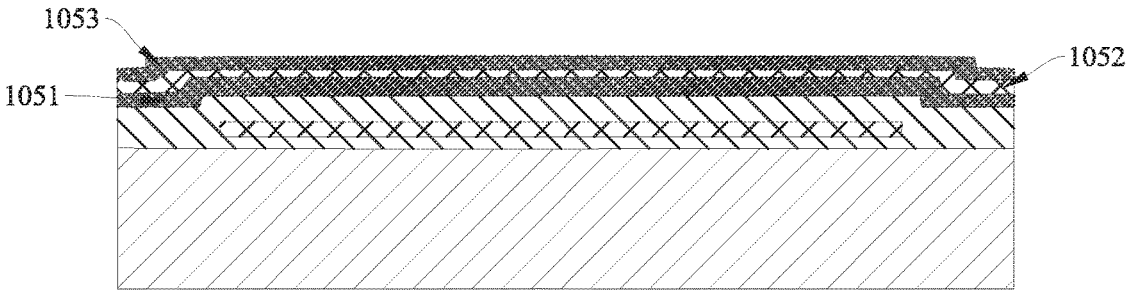

Step S2, prepare the back plate structure in the side space of the first vibrating diaphragm structure opposite to the first surface of the base:

Specifically, it comprises the following sub-steps:

S21, the second oxidation layer 1072 is deposited on the first diaphragm structure 104, the second oxidation layer 1072 such as 0.5 μm thickness, shown as FIG. 4D, preferably, in order to prevent the back plate 105 from adhering with the first diaphragm 104, groove structure formed, prepared and bumped by the second oxidization layer 1072 can be etched.

Figure 4F:
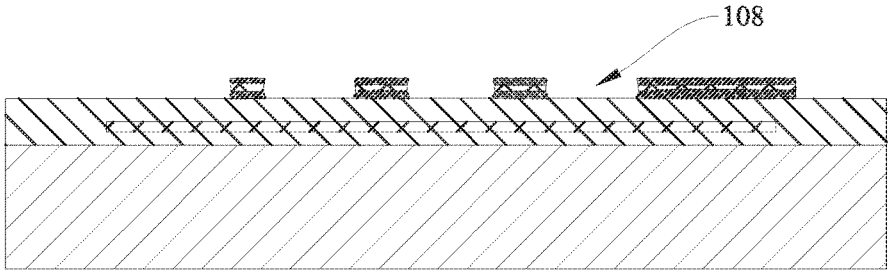

S22, the back plate material layer is deposited. In this embodiment, the back plate structure includes a first silicon nitride layer 1051, a second polycrystalline silicon layer 1052 and a second silicon nitride layer 1053 stacked from the bottom to the top, wherein the first silicon nitride layer 1051 covers the second oxide layer 1071; the first silicon nitride layer 1051 and the second silicon nitride layer 1053 have a thickness of about 0.25 μm, for example, and the second polycrystalline silicon layer 1052 in the middle has a thickness of about 0.5 μm;

S23, etch the back plate material layer to form an acoustic through-hole 108 arranged at intervals, as shown in FIG. 4F;

Preferably, the step of preparing bump on the surface of the second silicon nitride layer 1053 of the back plate is also included.

Figure 4G:
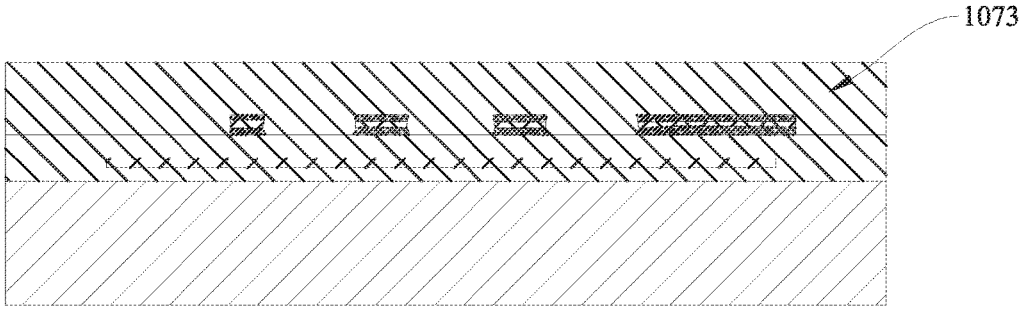

Step S3, prepare a second vibrating diaphragm structure in the side space of the back plate structure opposite to the first vibrating diaphragm structure;

Specifically, it comprises the following sub-steps:

S31, a third oxide layer 1073 is deposited on the upper surface of the back plate and flattened, as shown in FIG. 4G; the flattening referred to in this embodiment adopts chemical mechanical polishing (CMP) process for example.

Figure 4H:
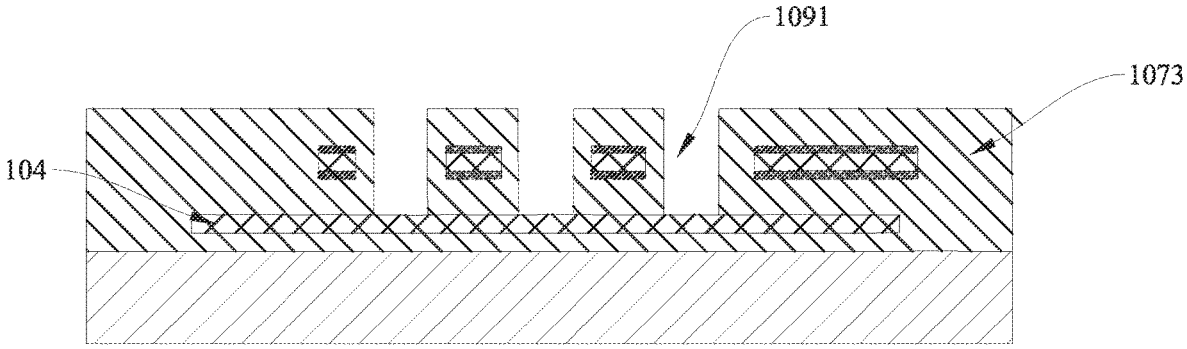
Figure 4I:
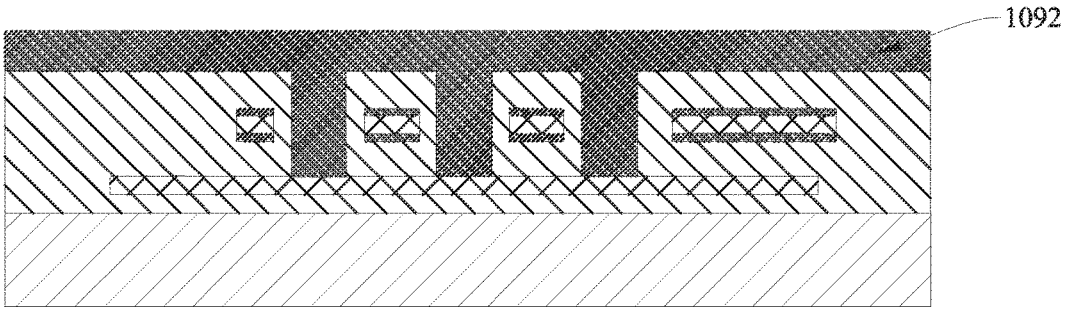
Figure 4J:
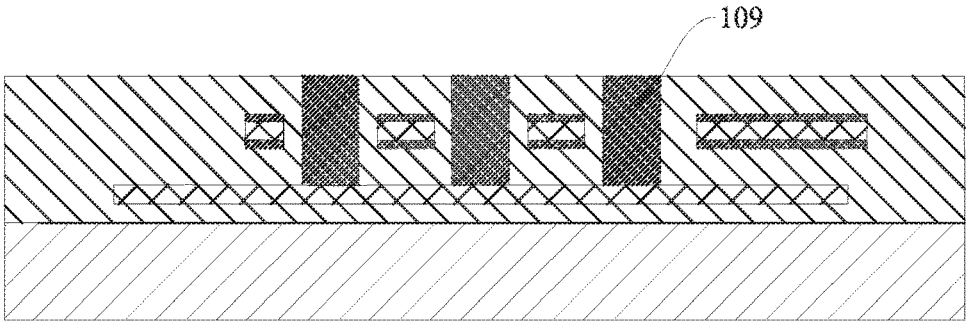
Figure 4K:
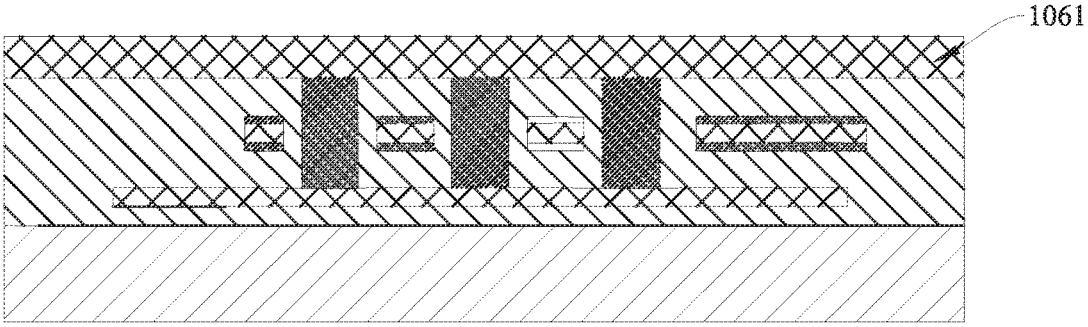
Figure 4L:
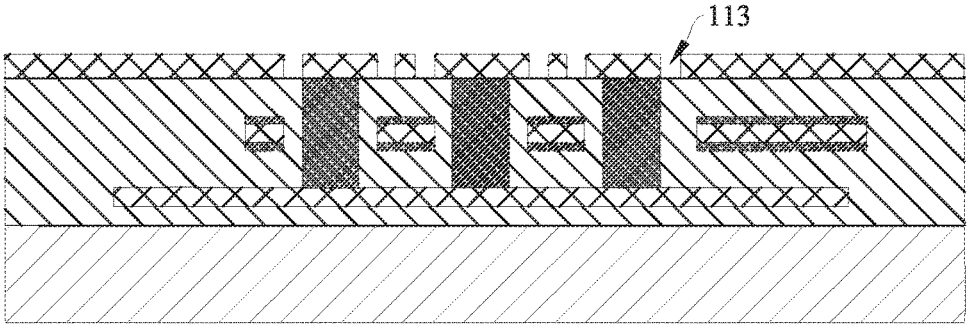

S32, the third oxide layer 1073 is etched to form a deposition hole 1091 of the supporting component 109, the deposition hole 1091 is located in the acoustic through hole 108 of the back plate, exposing the upper surface of the first diaphragm structure 104, as shown in FIG. 4H;

S33, a third silicon nitride layer 1092 is deposited to fill the deposition hole 1091, as shown in FIG. 4I; the thickness of the third silicon nitride layer 1092, for example, satisfies the requirement of completely filling the deposition hole 1091, about 4 microns;

S34, remove the third silicon nitride layer 1092 other than the support deposition hole 1091, such as CMP process, as shown in FIG. 4J;

S35, the thickness of depositing the third polycrystalline silicon film 1061 and the third polycrystalline silicon film 1061 for example is 1 μm, shown as FIG. 4K;

S36, etching the third polycrystalline silicon film 1061 layer, forming a releasing hole 113; obviously, the releasing hole is located outside the supporting component 109, which is used to remove the oxide layer between the first polycrystalline silicon layer 1041 and the third polycrystalline silicon layer 1061, which is located in the central main area, as shown in FIG. 4L.

Figure 4M:
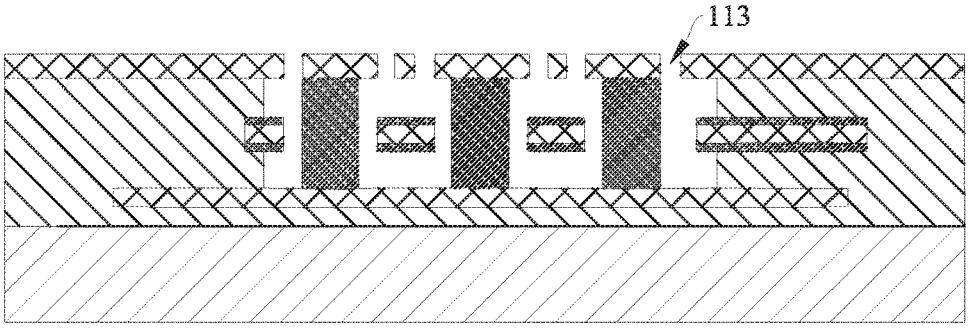

S37, release the oxide layer, such as using BOE solution or HF gas phase etching technology, remove the oxide layer under the third polycrystalline silicon until the first polycrystalline layer is exposed; form the first isolation gap between the first polycrystalline layer and the back plate and the second isolation gap between the third polycrystalline layer and the back plate. Because the size of acoustic through hole 108 on the back plate is larger than the size of supporting component 109, the A connected cavity 112 is formed between the first polycrystalline layer 1041 and the third polycrystalline layer 1061, as shown in FIG. 4M.

Figure 4N:
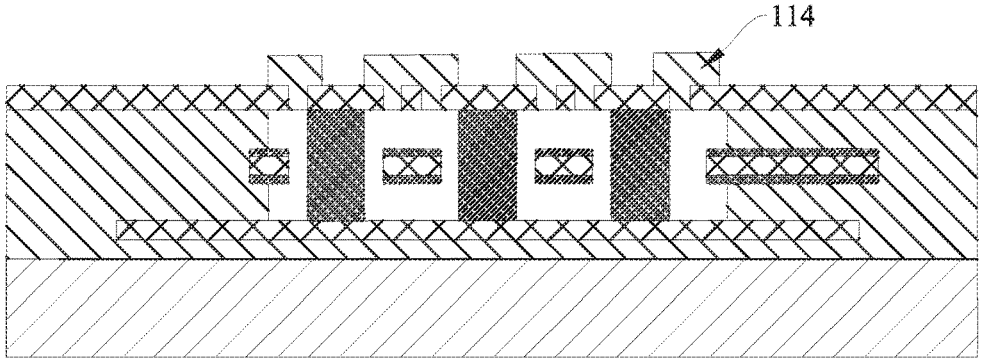

S38 is used to seal the releasing hole. For example, a polymer, an HDP oxide layer or a phosphosilicate glass (PSG) reflux process is used to form a sealing layer, and the sealing layer is etched to remove the redundant sealing layer 114 outside the release hole area, as shown in FIG. 4N.

Figure 4O:
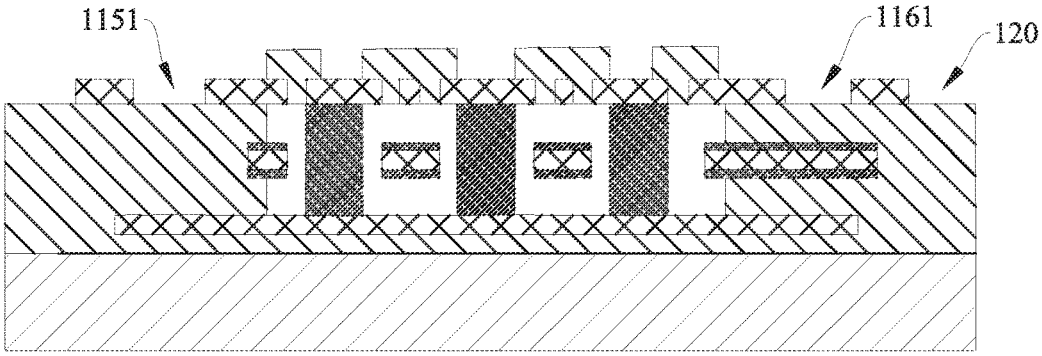

S39, etching the third polycrystalline layer 1061 to form the second diaphragm structure 106, mainly exposing the contact hole areas 1151, 1161 and the edge area 120 of the MEMS microphone base 101, as shown in FIG. 4O;

Step S4, prepare a contact electrode.

Figure 4P:
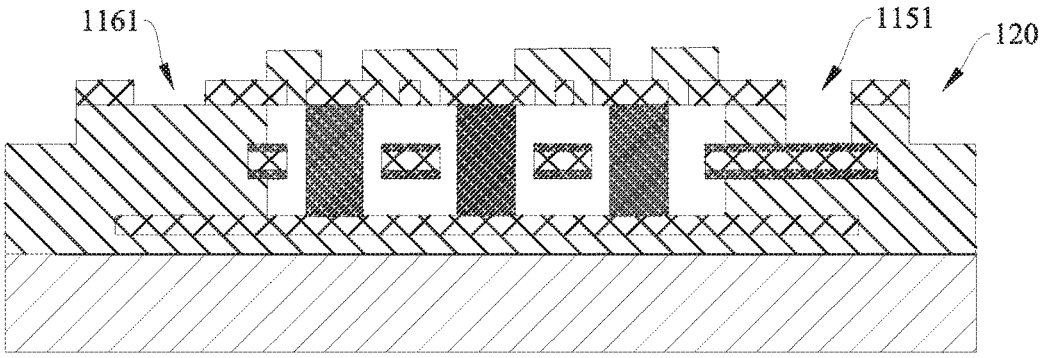
Figure 4Q:
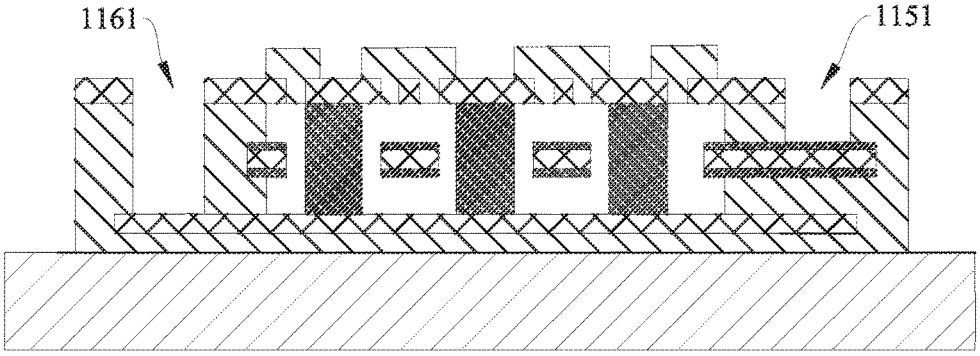
Figure 4R:
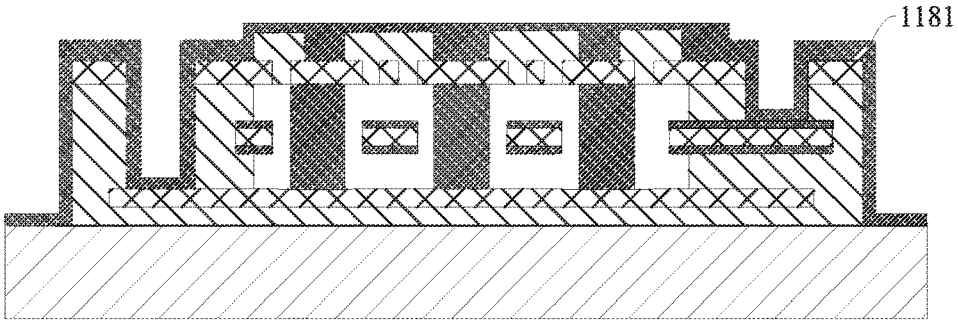
Figure 4S:
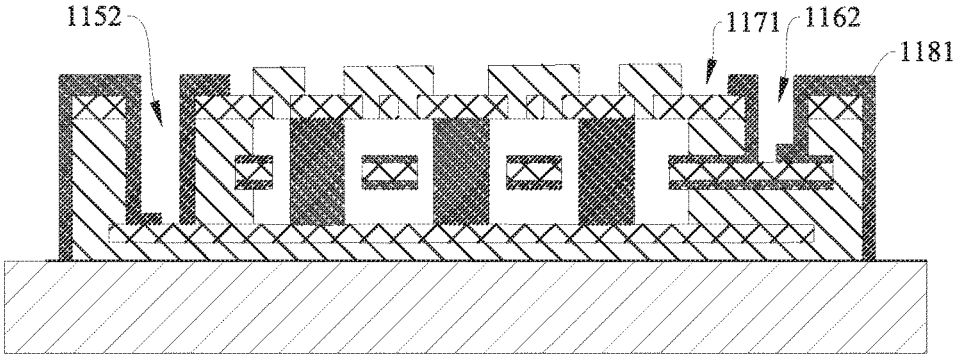
Figure 4T:
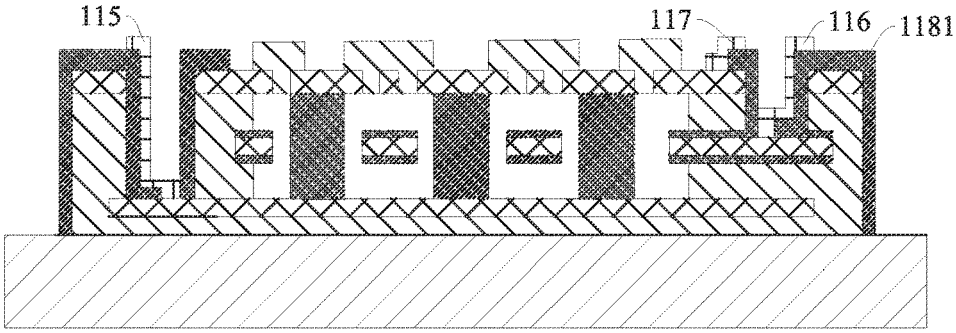

Specifically, it comprises the following sub-steps:

S41, etch the contact hole. In the first step, etch the first contact hole 1151 in the back plate area, as shown in FIG. 4P, and etch the same depth in the edge area 119; in the second step, etch the second contact hole 1161 in the first diaphragm 104 and the substrate silicon layer in the edge area of the MEMS microphone, as shown in FIG. 4Q;

S42, a passivation protective layer 1181 is deposited on the surface of the whole device, the passivation layer is silicon nitride for example, as shown in FIG. 4R;

S43, etch the passivation layer to expose the contact areas 1152, 1171 and 1162 of the first polycrystalline layer, the second polycrystalline layer and the third polycrystalline layer. In addition, if TBD is oxide, the passivation layer on the TBD layer needs to be reserved, as shown in FIG. 4S;

S44, a metal layer is deposited and patterned, such as Cr and Cu alloy. The patterned metal layer makes the first polysilicon layer, the second polysilicon layer and the third polysilicon form conductive contact points on the upper surface of the device, that is, the lead out electrode 115 led corresponding to the first diaphragm 104, the lead out electrode 116 led corresponding to the second diaphragm structure 106, and the lead out electrode 117 corresponding to the back plate structure 105;

Step 5, form the back cavity

Figure 4U:
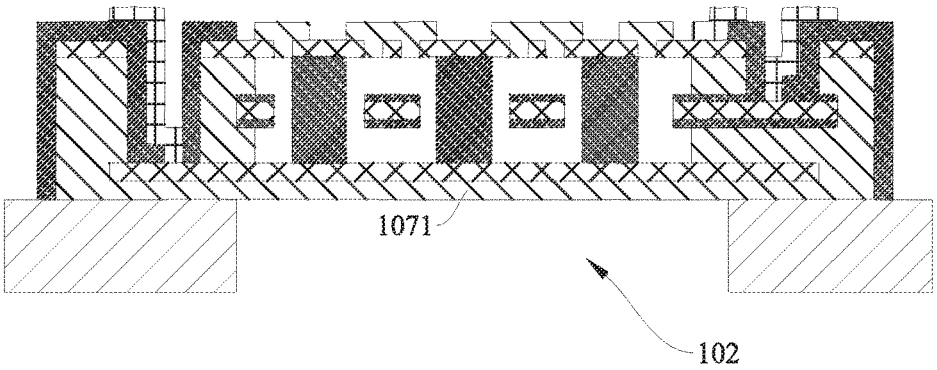
Figure 4V:
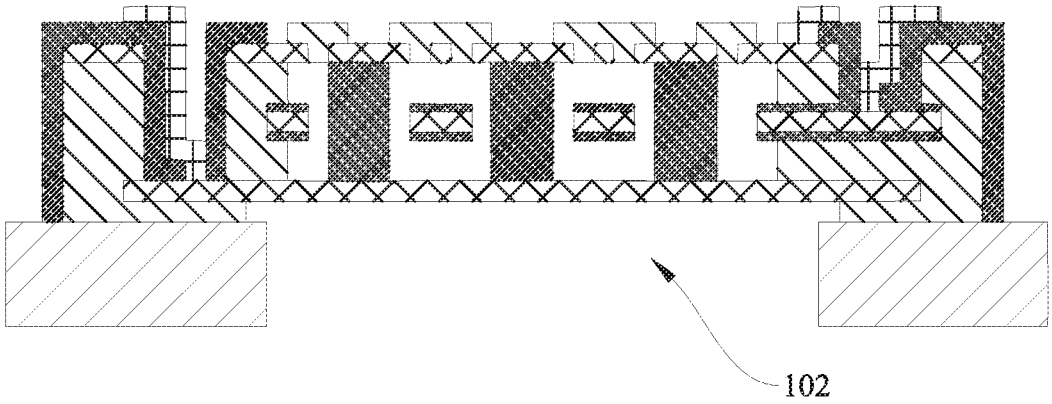

Specifically, it comprises the following steps:

S51, the back surface of the base is thinned, for example, the back surface of the base 101 is thinned by the grinding process;

S52, the second surface 101B of the patterned base is etched to form a back cavity area 102, and the etching stops at the first oxide layer 1071, as shown in FIG. 4U;

S53, remove the first oxide layer 1071 in the back cavity area, and complete the MEMS microphone manufacturing, as shown in FIG. 4V.

Preferably, it also comprises the step of forming a through hole 119 of the supporting part through the central area of the device, to form the MEMS microphone as shown in FIG. 2.

In the manufacturing method of the MEMS microphone provided by the invention, the preparation of the double diaphragm MEMS microphone is completed by using the standard semiconductor process, and is easy to integrate with other semiconductor devices.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A method for manufacturing a MEMS microphone including steps of:

select a base, deposit a first oxidation layer on the first layer of the base;

depositing a first polycrystalline silicon layer on a surface of the first oxide layer and graphing the first polycrystalline silicon layer for forming a first diaphragm structure;

depositing a second oxide layer on the surface of the first diaphragm structure;

depositing a material layer of back plate on the surface of the second oxidation layer; wherein the back plate material layer is patterned, and a plurality of acoustic through holes are formed in a middle main body area of the back plate material layer;

depositing a third oxidation layer on the back plate structure, and flatten the third oxidation layer; wherein the third oxide layer and the second oxide layer are patterned to form a supporting component deposition hole between the acoustic through holes, and the deposition hole of the supporting component exposes the first diaphragm structure;

depositing a material layer of supporting component to fill the deposition hole of supporting component;

flattening the surface of the third oxide layer to remove the supporting component material layer of supporting component outside the deposition hole of supporting component;

depositing a third polycrystalline silicon layer on the flattened surface of the third oxide layer to form a second diaphragm structure;

graphing the third polycrystalline silicon layer to form a plurality of releasing holes; wherein the second and third oxide layers between the first polycrystalline silicon layer and the third polycrystalline silicon layer and within the range of the middle main body area of the back plate are removed through the releasing hole to form an inner cavity;

depositing a sealing material layer on the third polycrystalline silicon layer for sealing the releasing hole, wherein the sealing material layer is patterned to remove the redundant part;

preparing an extraction electrodes of the first vibrating diaphragm structure, the second vibrating diaphragm structure and the back plate structure;

back-etching the base to form a back cavity area corresponding to the central main body area of the back plate structure.

2. The method for manufacturing the MEMS microphone as described in claim 1, wherein the step of depositing of the material layer of back plate comprises step of depositing a first nitride silicon layer, a second polycrystalline silicon layer and a second nitride silicon layer.

3. The method for manufacturing the MEMS microphone as described in claim 2, wherein the step of depositing of the extraction electrodes of the first vibrating diaphragm structure, the second vibrating diaphragm structure and the back plate structure comprises steps of:

etching for forming electrode extraction holes of the first vibrating diaphragm structure, the back plate structure and the second vibrating diaphragm structure;

depositing and visualizing the electrode layer, form the first extraction electrode of the first vibrating diaphragm structure, the second extraction electrode of the second vibrating diaphragm structure, the third extraction electrode of the back plate structure.

4. The method for manufacturing the MEMS microphone as described in claim 1, wherein the step of forming back cavity comprises steps of:

thinning and etching the base from the second surface of the base;

eliminating the first oxidation layer under the first vibrating diaphragm structure and corresponding to the back cavity structure.

5. The method for manufacturing the MEMS microphone as described in claim 1, wherein a step of depositing a passivation protective layer after forming an electrode outlet hole is further included.

6. The method for manufacturing the MEMS microphone as described in claim 1 including at least one through hole through the first diaphragm structure, the supporting component and the second diaphragm structure for communicating the back cavity with the external environment.

7. The method for manufacturing the MEMS microphone as described in claim 1, further comprising a step of forming a bump on the upper and lower surfaces of the central main body area of the back plate structure.

8. The method for manufacturing the MEMS microphone as described in claim 1, wherein the material of the supporting component includes silicon nitride.

9. The method for manufacturing the MEMS microphone as described in claim 1, wherein the electrode material includes Cr and Au.

* * * * *